United States Patent [19]

Mejia

[11] Patent Number: 4,686,154

[45] Date of Patent: Aug. 11, 1987

[54] SECURITY SYSTEM LABEL

[75] Inventor: Ezequiel Mejia, Longueuile, Canada

[73] Assignee: Sigma Security Inc., Toronto, Canada

[21] Appl. No.: 585,074

[22] Filed: Mar. 1, 1984

[30] Foreign Application Priority Data

Oct. 20, 1983 [CA] Canada ..... 439389

[51] Int. Cl.[4] ..... H01F 1/00; G08B 13/26

[52] U.S. Cl. ..... 428/611; 340/551; 340/572; 428/636; 428/668; 428/686; 428/212; 428/332; 428/692; 428/697; 428/900; 428/916; 428/928

[58] Field of Search ..... 428/697, 916, 900, 611, 428/636, 668, 686, 212, 332, 693, 692; 340/572, 551

[56] References Cited

U.S. PATENT DOCUMENTS

| | | | |
|---|---|---|---|
| 3,328,195 | 6/1967 | May | 428/928 |
| 3,499,739 | 3/1970 | Segal | 428/928 |
| 3,631,442 | 12/1971 | Fearon | 340/572 |
| 3,665,449 | 5/1972 | Elder et al. | 340/572 |
| 3,747,086 | 7/1973 | Peterson | 340/572 |
| 3,765,007 | 10/1973 | Elder | 340/572 |
| 3,811,977 | 5/1974 | Kramer | 428/900 |
| 3,820,104 | 6/1974 | Fearon | 340/572 |
| 3,938,125 | 2/1976 | Benassi | 428/686 |
| 4,205,120 | 5/1980 | Morizot et al. | 428/928 |
| 4,222,517 | 9/1980 | Richardson | 340/572 |
| 4,237,189 | 12/1980 | Deffeyes | 428/457 |
| 4,298,862 | 11/1981 | Gregor et al. | 340/572 |
| 4,300,183 | 10/1981 | Richardson | 340/572 |
| 4,309,697 | 1/1982 | Weaver | 340/572 |
| 4,484,184 | 11/1984 | Gregor et al. | 340/572 |
| 4,495,487 | 1/1985 | Kavesh et al. | 340/572 |
| 4,510,489 | 4/1985 | Anderson, III et al. | 340/572 |
| 4,510,490 | 4/1985 | Anderson, III et al. | 340/572 |
| 4,553,136 | 11/1985 | Anderson, III et al. | 340/572 |

*Primary Examiner*—George F. Lesmes
*Assistant Examiner*—William M. Atkinson
*Attorney, Agent, or Firm*—Alan H. Levine

[57] ABSTRACT

A security label comprised of at least two magnetically soft materials having different coercivities but similar thresholds of magnetic saturation.

10 Claims, 12 Drawing Figures

SECURITY SYSTEM LABEL

Figure 1:
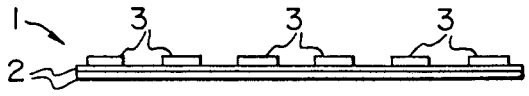

This invention relates to shoplifting detection devices, and particularly to a security label which can be attached to goods, and which can be detected at the exit of a protected area.

Shoplifting has for some time been a major commercial problem, resulting in substantial losses by stores, libraries, etc. Consequently a detection system for shoplifted goods has been used, in which a strip of magnetic material is attached to goods to be protected, and the tag is detected at the exit to the store, library, etc. At the exit, a person carrying the goods must pass through a AC magnetic field, which field is modified by the strip of magnetic material. The modified magnetic field is detected, and the modification thereof provides an indication that the tag, and therefore the goods, are being removed in an unauthorized manner. An alarm is then automatically sounded.

If the strip of magnetic material is removed or its magnetic characteristics modified or nullified by a checkout clerk, the AC magnetic field at the exit is not modified, and no detection of a modified field results, thus allowing transportation of the goods through the field without setting off an alarm.

The basic detection system was proposed by P. A. Picard, and described in French Patent 763,681, issued in 1934. Picard described a system in which certain key concepts, that the modification of the AC field, that is, the appearance of harmonics of the fundamental frequency of the AC field caused by the tag are unique to the material of the tag, and that the size and shape of the tag only modifies their amplitude, are fundamental. Improvements to the system were invented, by R. E. Fearon, as described in U.S. Pat. No. 3,631,442 issued Dec. 21, 1971, by G. Peterson, as described in U.S. Pat. No. 3,747,086 issued July 17, 1973, J. T. Elder et al, as described in U.S. Pat. No. 3,665,449, issued May 23, 1972, Paul E. Bakeman, Jr. et al, as described in U.S. Pat. No. described in U.S. Pat. No. 3,983,552 issued Sept. 28, 1976, and others. In such systems, an AC magnetic field is set up at an exit to a protected establishment, and various selected harmonics of the modified magnetic field are detected, representing the presence of the material of the tag.

One of the major problems encountered by such systems is that false alarms are sometimes set off by the detection of harmonics to the fundamental field frequency caused by metal articles worn or carried by customers of the establishment (eg. belt buckles, keys, jewelry, etc.). Clearly an accusation of theft by an establishment against the customer who has set off the alarm innocently is embarrassing to all involved parties, and can result in the loss of a good customer to the establishment. Consequently, it is believed that due to unreliability such systems have not gone into as widespread use as they otherwise might.

In the aforenoted U.S. Patents to J. T. Elder et al and Paul E. Bakeman et al, it is suggested that more than one element can be used in the tag. Where the tag contains two or more elements, it is suggested that they can be of different permeabilities, to produce output signals which are more complex and distinctive than those produced by a marker or tag having single permeability. Detection of resultant field output pulses based on the combination should considerably increase the reliability of detection, since it is unlikely that another article carried or worn by a person would contain the same combination of coercivities and thus the same combination of harmonics.

The latter system, in brief, works as follows. A strip of material having soft (easily magnetized and demagnetized) magnetic characteristics is subjected to the AC magnetic field, having a field intensity sufficient to saturate the magnetic material during each polarity of its AC excursions. The resulting magnetic field is monitored. The resulting AC field will have a pulse superimposed on its positive and negative half cycles at each excursion at each point at which the magnetic material saturates. A Fourier analysis of the pulse establishes the harmonic content, and in the prior art, particular harmonics are detected which, if present, cause an alarm to be set off. In the Elder and Bakeman Jr. et al patents, the harmonic content and the odd and even harmonic content relationship can be more complex, and therefore more carefully and accurately determined than previously.

However, I have found that such multiple-material tags have further deficiencies which decrease their reliability. For example, the orientation of the tag within the field may be such that only a very weak pulse appears, or no pulse at all, for one of the materials of the tag, relative to the other. In other words, the harmonics cannot be detected, or can be detected only weakly. In addition, as a person carrying the goods with the tag attached passes through the field, the orientation of the tag relative to the field almost invariably changes. Consequently the amplitude relationship of the pulses, and therefore of the harmonics, change with time, and consequently the harmonic relationships which are detected change (the amplitude of one pulse relative to the other can be so low that they do not appear and cannot be detected). For example, if a pulse of the form of a half sine wave should be detected if a piece of magnetic material is fully saturated, a given set of harmonics will be generated. However if only the phase portion of the sine wave between 40° and 50° is established as the pulse, clearly many of the hi9her harmonics will be absent. Thus where a multiple-element tag is to be used, an unreliable result can occur due to the different responses of the different materials in the AC magnetic field, and due to different orientations and movement of the tag in the field during detection thereof. Yet it is precisely the different magnetic characteristics of the two tag materials which is alleged to facilitate a more reliable detection than the single material tag.

The present invention is a tag system which overcomes the aforenoted problem of unreliable response due to different tag materials, orientation, and movement in the AC magnetic field. This is achieved by the use of a security label comprised of two magnetically soft materials having different coercivities but similar magnetic saturation thresholds. The different coercivities causes saturation to occur at different times (resulting in multiple pulses in the received waveform, but equal amplitudes).

Because the amplitudes of the multiple pulses are equal, it has been found not necessary to filter, or perform fast Fourier analysis of the pulses (although this could be done), but only amplitude ratios between the pulse maxima and the minimum between the pulses need by determined. In other words, the two pulse amplitudes must be equal, and occur in a predetermined time relationship, and the ratio of the pulse amplitudes to the minimum between the pulses must be within a predetermined range, or the multiple tag is assumed not to be present. These criteria have been found to provide extremely reliable tag detection, without the requirements for expensive, slow, and possibly unreliable harmonic presence and relationship determination. However the present invention relies directly on the use of the magnetic label having at least two magnetically soft materials having different coercivities, but similar magnetic saturation thresholds. Indeed, this can be provided by having the different materials of the tag (preferably in the form of strips) made of the same alloys. Because the materials are the same, as predicted by Picard, it would be expected that the coercivities would be identical. However, some materials have been determined to have different coercivities, but similar magnetic saturation thresholds. This can be obtained in some materials by heat treating the two similar strips differently.

In addition, where different materials are used to make up the tag, there is a substantial possibility of galvanically-caused corrosion, particularly in a humid atmosphere. Consequently it is dangerous to make the strips so small and light that they could be inserted permanently into clothing, i.e., into the lining of a shirt collar for example, since following washing and exposure to the air, staining of the clothing could occur. Consequently with prior art multiple material tags, it was preferable that they should be cut off the goods after removal from the store. This of course provides information as to the presence and location of the tag.

With the present invention where the same material is used for the tag, there is no possiblity of galvanic action between the materials. Consequently the tags can be permanently hidden, e.g. in a shirt collar, a seam, lining, etc. However once deactivated, the tag will not set off an alarm if the person, carrying or wearing the purchased article of clothing, enters the detection field.

In addition, the preferred materials used in the inventive tag are highly inert, and have substantial corrosion resistance, approaching that of stainless steel.

Figure 2:
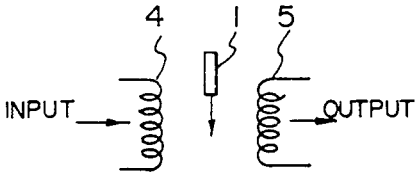
Figure 3:
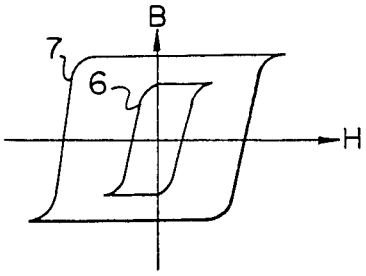
Figure 4:
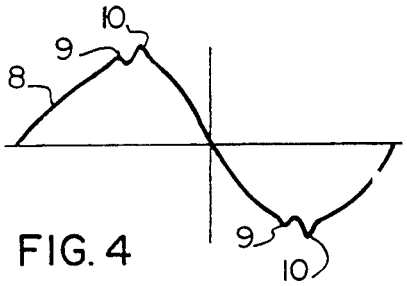
Figure 5:
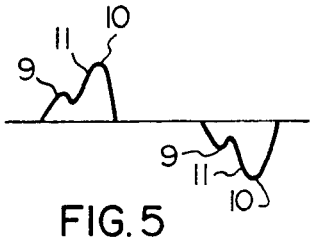
Figure 6:
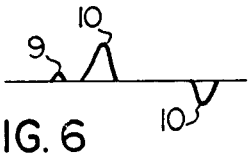
Figure 7:
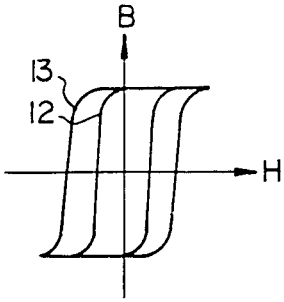
Figure 8:
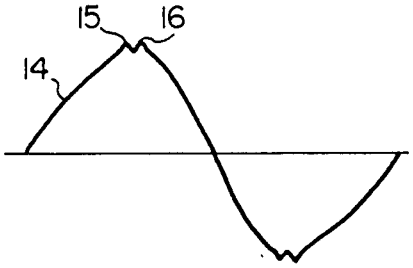
Figure 11:
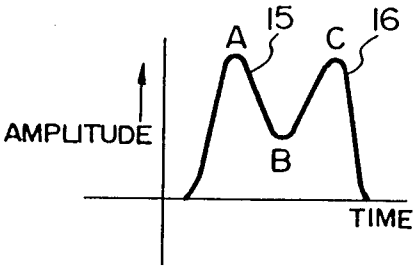
Figure 10:
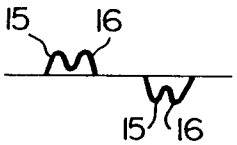
Figure 9:
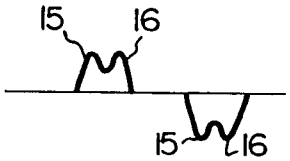
Figure 12:
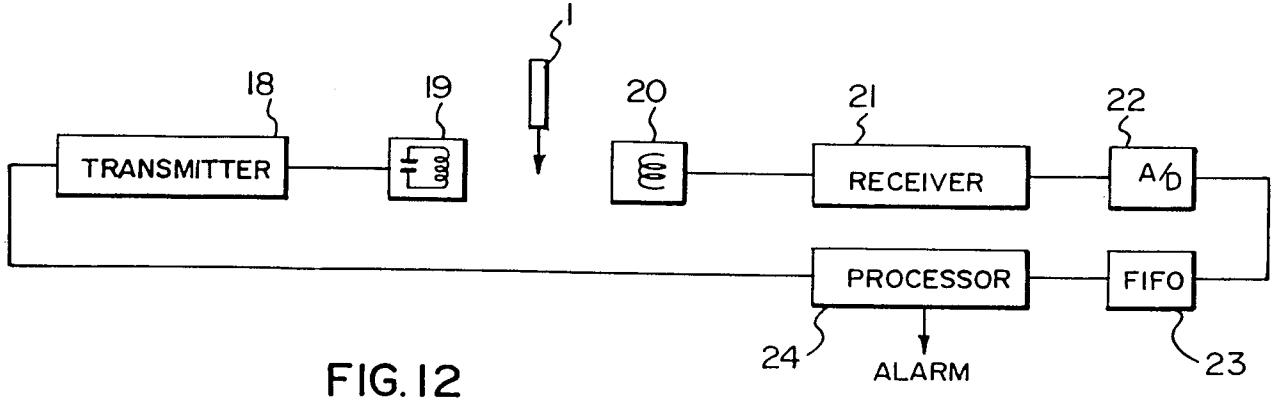

A better understanding of the invention will be obtained by reference to the detailed description below, in conjunction with the following drawings, in which;

FIG. 1 is an edge view of the preferred form of tag according to the present invention, FIG. 2 illustrates how the tag is to be energized and its presence detected, FIG. 3 is a magnetization curve of multiple element tags according to the prior art, FIG. 4 is a representative detected waveform according to the prior art, FIGS. 5 and 6 are representative curves of the pulses detected in the received waveforms according to the prior art, FIG. 7 is a magnetization curve of the tag according to the present invention, FIG. 8 is the received waveform after an energization of the tag according to the present invention, FIGS. 9 and 10 are curves of the received waveform of FIG. 8, FIG. 11 is an enlarged view of the waveform of FIG. 9, and FIG. 12 is a block diagram of a system for energizing and detecting the tag according to the present invention.

Turning first to FIG. 1, a tag 1 is shown according to the preferred form of the invention. The tag is made up of two or more strips 2 of soft magnetic material, laminated together and with short strips of hard magnetic material 3 spaced along one side thereof. Each of the strips 2 preferably is about 5 cm. long, 3 mm. wide and 0.04 mm thick. Each portion of magnetically hard material can have length and width each of 3 mm. and spaced 1 cm. apart.

The soft magnetizable material preferably has permeability of between 50,000 and 500,000. Due to the size and flexibility of the strips, they can easily be sewn into the lining or collar of shirts, sewn into the hem of skirts and dresses, fitted into the covers of books, etc.

According to the prior art, each of the strips 2 is formed of different magnetic material, having different coercivities. Turning for a moment to FIGS. 2 and 3, the basic operation thereof will be described.

An AC signal is applied to a transmitting coil 4, which is located adjacent an exit to the establishment to be protected. An AC magnetic field is set up, through which a customer, carrying thegoods with the tag 1, must pass.

A receiving coil 5 is located so as to detect the resulting magnetic field.

When the tag 1 passes between the coils, it modifies the magnetic field. Each of the strips 2 is driven into saturation as the field intensity builds up, is removed from saturation as it is reduced, and is driven into saturation with opposite polarity as the field builds up in the opposite polarity direction. The saturation characteristics of the two materials are shown in FIG. 3, as well known hysteresis curves 6 and 7.

Assuming that the input waveform to transmitting coil 4 is a sine wave, the received output waveform would typically be as shown in FIG. 4. Pulses superimposed on the waveform 8 correspond to where the individual materials of the strips 2 saturate. For example, the strip material having hysteresis curve 6 will cause pulse 9 to occur on the positive and negative excursions of the received waveform, while the material of the strip having hysteresis curve 7 will cause pulse 10 to occur on the waveform 8 corresponding to the time when it saturates.

According to the prior art, these pulses are filtered, forming the waveforms 11 shown in FIG. 5, which are then analyzed for harmonic content, and the ratio of specific even to odd harmonics are determined, to establish the presence of the tag.

Since a single tag material would only cause a single pulse in each polarity excursion, clearly a multiple material tag will cause a more complex wave form, and thus a more complex relationship of harmonics to occur. This, theoretically, would facilitate a more reliable indication of the presence of the multiple material tag. We will discuss this further below.

However returning briefly to FIG. 1, it was noted that hard magnetic material 3 was also laminated with the tag. Deactivation of the tag will occur if the entire tag is brought into adjacency with a strong unidirectional magnetic field. This brings hard magnetic material 3 into saturation, which result in a remanent magnetic field held by the hard magnetic material 3. This remanent field biases the soft magnetic material into saturation, deactivating it.

When the deactivated tag is brought into the AC magnetic field to be detected, it no longer is caused to move in and out of saturation, since it is permanently saturated by the remanent magnetic field of the hard magnetic material. Of course the alternating magnetic field should not be so strong as to magnetize the hard magnetic material, but should be sufficient to drive the soft magnetic material into saturation when the tag has not been deactivated.

In summary, when the tag has been deactivated, there will be no resulting output pulses caused by the soft magnetic material being driven in and out of saturation, and consequently the detection apparatus does not generate an alarm operation signal.

Returning now to the prior art detected pulse waveform shown in FIG. 5, it will be noted that due to the presence of different magnetic materials, a complex waveform appears. However, in prior art multiple material tags, the amplitudes of the pulses are different, as predicted by Picard. For example, as shown in FIG. 5, the amplitude of pulse 9 is lower than the amplitude of pulse 10.

Difficulty arises with such prior art multiple tag systems when the orientation of the tag or movement of the tag causes a very weak response to occur. In this case the amplitudes of the received pulses decrease, as shown in FIG. 6. In the case shown the amplitude of pulse 10 in one polarity direction is high, but the amplitude of pulse 9 is just barely discernible. In the opposite polarity direction, the amplitude of pulse 10 has decreased (due to movement of the tag as the article passes through the field), and the pulse 9 is not detected at all.

Clearly the detected harmonics and ratios of selected harmonics will be substantially different from the detected waveforms of FIG. 6, relative to that of the waveforms of FIG. 5, since the waveforms are so different.

It will also be recognized that with the use of a very small tag (as would be highly desirable), the amplitudes of the detected waveforms are smaller than if the tag is large. In this case the detected pulses would actually be imbedded in noise, and indeed, pulse 9 could be virtually undetectable due to the noise.

The present invention provides a substantial improvement over the prior art multiple-material tags both in reliability and ease of detection. According to the present invention, a tag is formed of at least two magnetically soft materials having different coercivities, but similar thresholds of magnetic saturation. Hysteresis curves of a tag according to the present invention (disregarding the hard magnetic material) is shown in FIG. 7. The hysteresis curve 12 corresponds to the magnetic characteristic of one of the strips 2, and hysteresis curve 13 corresponds to the magnetic characteristics of the other of the strips 2. Clearly the coercivities of the strips are different, but the saturation thresholds are similar.

When an active tag is brought into an AC magnetic field which resulting field is detected, as described with reference to FIG. 2, the resulting output waveform 14 is as shown in FIG. 8. In this case two pulses 15 and 16 are observed, both having similar amplitudes.

After filtering from the main waveform,the resulting pulses appear as shown in FIG. 9. Where the tag is only weakly detected, or in the event of movement through the field, a reduced amplitude pair of pulses 15 and 16 are detected, as shown in FIG. 10. However it should be noted that since the pulse amplitudes are equal amplitude, as long as one pulse is detected, the second pulse must also be detected, since one pulse will never be of lower amplitude than the other. Consequently the waveform analysis will, for virtually all cases except where the pulses are undetectable, always be the same.

While it may be possible to design the two magnetically soft materials to have different alloy constituents, to provide different coercivities but similar magnetic saturation thresholds, it is preferred that the two or more magnetically soft materials should be made of the same alloy. It was predicted by Picard that such material would provide similar coercivity characteristics, but different amplitude if made of different shapes and sizes. However it has been found that by heat treating the two similar alloy materials differently, their coercivities are rendered different, but, for similar size and configuration materials, their saturation thresholds remain similar. Such materials are ideal for the present invention.

However, in some cases it may be desirable to have the size (e.g. the width) of one strip of material different from the other in order to achieve similar thresholds of saturation.

It is thus preferred that the strips should be formed of the same amorphous alloy $CO_{66}Fe_4(Mo,Si,B)_{30}$, each having been differently heat-treated to obtain different coercivities but similar magnetic saturation thresholds. This alloy is sold as trademarks VITROVAC 6025X and VITROVAC 6025Z-2 respectively. When identically sized and laminated as described with respect to FIG. 1, a tag according to the preferred form of the invention is obtained. Indeed, the corrosion resistance of this material has been found to be superior to stainless steel, and the galvanic reaction between the two materials negligible. The VITROVAC material is sold by Vacuumschmelze GMBH of Hanau West Germany.

While laminated strips are preferred to form the tag, it is not a requirement that they should be laminated to form a useful tag. For example, they can be held in adjacency by any means, such as by a plastic pocket, etc.

FIG. 11 shows the waveform of FIG. 9 enlarged. For a difference in permeability of about 50,000, it has been found that in a 12 kHz AC magnetic field, a typical difference in time between peaks 15 and 16 is about 400 nsecs. According to the preferred form of detection, the relative amplitudes of the waveform peaks shown at A and C are detected relative to the trough B between the peaks. An indication of the presence of the tag is provided upon a simple determination of the relative amplitudes being greater than a predetermined relative amplitude. This has been found to be a reliable first indication of the presence of both tags, without requiring analysis of the signals for harmonic content, as required in the prior art.

A second indication of the presence of the tag is preferably obtained by detecting the timing of the peaks relative to each other. As indicated earlier, for a predetermined permeability difference, the timing difference between the peaks is about 1500 nsec. In the event noise is detected, it is highly unlikely that repeating peaks will be detected within a predetermined range approximately 1500 nsec. apart.

Thus a first indication of the amplitude ratios, and a second indication of the timing, both of which can be repeated several times as the tag passes through the field, gives a highly reliable indication of the presence of the tag.

A contrast of the present invention with that of the prior art will now become evident. Clearly even if amplitude detection were utilized of the prior art tag detected peaks, if the amplitude is very weak or masked by noise, one of the peaks cannot be detected, resulting in an unreliable detection. In the present invention, either both peaks are present to an equal degree or none of the peaks are present and detected.

Further, in the prior art, for low amplitude signals the ratios of the amplitudes (i.e. the difference between the dip to peak amplitudes) vary as the signal amplitude changes. In the present invention, as long as the signal amplitude is detectable, the amplitude differences remain the same.

Since the harmonics of the detected pulses need not be analyzed, the detection and alarm circuitry can be considerably simplified over that of the prior art. FIG. 12 shows a block diagram of a security label detection system according to the present invention. A transmitter 18 applies an AC signal to, preferably a resonant transmitting coil and capacitor 19 which coil, for example, can be approximately 1½ feet in diameter, with a capacitor connected in parallel therewith to make the combination resonant to the signal output from transmitter 18 (e.g. about 12 KHz.).

A receiving coil 20, located across an area where the object to be detected is passed during exit from the establishment to be protected, is connected to a receiver 21. The receiver can be comprised of a high pass filter for removing the 12 KHz. signal, and automatic gain control, etc. The output signal of receiver 21, which consists of the pulses 15 and 16, is applied to an analog to digital converter 22, which samples the pulses, converts them into digital form, and applies them to a first in—first out (FIFO) register 23. The output of FIFO 23 is applied to a microprocessor 24, which is connected to drive transmitter 18. An output of microprocessor 24 provides an alarm signal for operating an alarm to indicate that the tag has been detected.

In operation, the activated tag 1, which is to be detected, is passed within the AC magnetic field generated by coil 19, under control of transmitter 18. The resulting magnetic field is detected in coil 20, and the resulting output waveform 14 as shown in FIG. 8 is applied to receiver 21. In receiver 21 the 12 KHz signal is removed, and the resulting signal comprised of pulses 15 and 16 are output and applied to analog to digital converter 22. The digitized signal is applied FIFO 23, from which it is applied to processor 24.

The processor operates to detect a signal maximum, followed by a minimum, which is then followed by another maximum in the digitized signal output from FIFO 23, for each digitized set of analog pulses. Clearly the prior art systems could only unreliably detect such peaks, in the presence of different and low amplitude peaks, since one of the peaks may not be present or be masked in noise. Further, such prior art systems ignore the relative amplitudes of the peaks and troughs, and attempt to analyze the harmonic content of the complex waveform.

In the present invention the processor 24 then determines the relative amplitudes of the points A, B, C, as described earlier with reference to FIG. 11. This, of course, provides the first indication of the presence of the tag. This was not possible to do in the prior art, since the object of the prior art was to detect harmonics and harmonic ratios for specific harmonics.

The processor 24 further determines the relative time between points A and C in FIG. 11 and the time of the trough B between them. As noted earlier, the prior art neither considered nor was able to provide this function.

The processor 24 then determines the similarity between the detected relative amplitudes and times of sequences of adjacent pulses. If a predetermined number (e.g. 3 successive detections meeting the required criteria) are detected then an alarm signal is generated. Clearly the present invention is substantially immune to noise or false peaks, and the presence of equal amplitude peaks substantially increases the reliability.

In the prior art, due to the variation in amplitudes of the two peaks as the tag moves through the field, with the changing harmonic mix due to the different signal wave shapes, similarity between successive detected pulse signals could not be reliably correlated. Due to the similarity of peak amplitudes using the tag according to the present invention, there will be substantial correlation between successive groups of pulses, allowing the described circuit to reliable correlate successive received signals, substantially increasing its reliability of detection.

The processor can also be used to drive the transmitter, facilitating the timing of the signal applied to the transmitting coil 19, with the analysis timing. Indeed, the processor 24 can be programmed to drive a group of coils 19 located at angles to each other, the field from which can be received by a group of receiving coils 20 located at angles to each other, the received signals from which can be added together to provide a stronger output signal for analysis thereof, and to insure that the tag effects the field maximally.

It may thus be seen that a novel type of tag has been invented, which has different coercivities but similar saturation threshold characteristics, which facilitates substantially more reliable tag detection than previously, and which can be detected using simplier apparatus. Further, while a 2 soft material tag has been described, more complex detection of peak timing and peak and trough ratios can be effected by utilizing a tag having more than two soft magnetic materials.

A person who has studied this specification and understands the invention may now conceive of other alternatives or variations, using the principles described herein. All considered to be within the sphere and scope of this invention defined in the claims appended hereto.

I claim:

1. A security label for producing pulses detectable from an applied magnetic field comprised of at least two distinct closely spaced and similarly magnetically oriented elements formed of magnetically soft materials, the elements having different coercivities but equal magnetic saturation thresholds.

2. A security label as defined in claim 1, further including short strips of a third magnetizable material having high coercivity relative to the coercivities of said magnetically soft materials and disposed in fixed spaced positions adjacent to and along at least one face of said magnetically soft materials so as to magnetically bias the magnetically soft materials into saturation when the third magnetizable material has been remanently magnetized, the two magnetically soft materials both being amorphous thin strips of the same alloy $Co_{66}Fe_4(Mo,Si,B)_{30}$, each having been differently heat-treated to obtain different coercivities but equal magnetic saturation thresholds.

3. A security label as defined in claim 2, in which each of said strips are several centimeters long, less than a centimeter wide, less than a millimeter thick, and laminated together.

4. A security label as defined in claim 1 or 2, in which one of the two materials has a shape different from the other whereby equal magnetic saturation thresholds are achieved.

5. A security label as defined in claim 1 in which each of the materials is in the form of a thin strip fixed facing and adjacent the other.

6. A security label as defined in claim 5 in which the strips are both similar materials similarly shaped, each having different coercivities.

7. A security label as defined in claim 1, 5 or 6, further including a third magnetizable material having high coercivity relative to the coercivities of said two materials fixed in adjacency to said soft magnetizable materials so as to magnetically bias the magnetically soft materials into saturation when the third magnetizable material has been remanently magnetized.

8. A security label as defined in claim 1, 5 or 6, further including short strips of a third magnetizable material having high coercivity relative to the coercivities of said magnetically soft materials desposed in fixed spaced positions adjacent to and along at least one face of said magnetically soft materials so as to magnetically bias the magnetically soft materials into saturation when the third magnetizable material has been remanently magnetized.

9. A security label as defined in claim 1, 5 or 6 in which said materials are amorphous metallic alloys.

10. A security label as defined in claim 1, 5 or 6, in which both the materials are strips of the same alloy $Co_{66}Fe_4(Mo,Si,B)_{30}$, each having been differently heat-treated to obtain different coercivities but equal magnetic saturation thresholds.

* * * * *